US007413373B1

(12) United States Patent
Attar

(10) Patent No.: US 7,413,373 B1
(45) Date of Patent: Aug. 19, 2008

(54) UNITARY BODY FOR REFLECTIVE PAVEMENT MARKER

(76) Inventor: Adil H. Attar, P.O. Box 6153, Irvine, CA (US) 92616

( * ) Notice: Subject to any disclaimer, the term of this patent is extended or adjusted under 35 U.S.C. 154(b) by 0 days.

(21) Appl. No.: 11/601,912

(22) Filed: Nov. 20, 2006

(51) Int. Cl.
*E01F 11/00* (2006.01)

(52) U.S. Cl. ..... 404/14; 404/12; 404/16

(58) Field of Classification Search ..... 404/12–16
See application file for complete search history.

(56) References Cited

U.S. PATENT DOCUMENTS

| | | | | |
|---|---|---|---|---|
| 6,811,729 | B2 * | 11/2004 | Attar | 264/1.9 |
| 7,001,100 | B1 * | 2/2006 | Attar | 404/16 |
| 2003/0012599 | A1 * | 1/2003 | Wallgren et al. | 404/14 |

* cited by examiner

*Primary Examiner*—Raymond W Addie

(57) ABSTRACT

Improved reflective pavement marker is disclosed having a unitary hollow structural body molded in situ about at least one pre-formed retro-reflective lens plate. The unitary structural body has a base surface partially sealed with a compatible sheet includes exterior surface with multiple protruded grooves.

An alternative structural body can have a sealed base surface including multiple protruded and recessed grooves with at least one inclined face having a recessed area for receiving a pre-formed lens plate attachment.

The planar base surface of said unitary structural body includes an impact absorbing hollow cavities extending along the sides of the inclined reflective faces and incorporate multiple of protruded rectangular grooves.

The structural body can incorporate various pigmentations or luminescent colorant compounds such as compounds containing thioxanthene dyes or phosphorescent pigment such as strontium to provide fluorescent self emitting light after glow to improve day and night visual display when illuminated with light within the ultraviolet wavelength range.

10 Claims, 7 Drawing Sheets

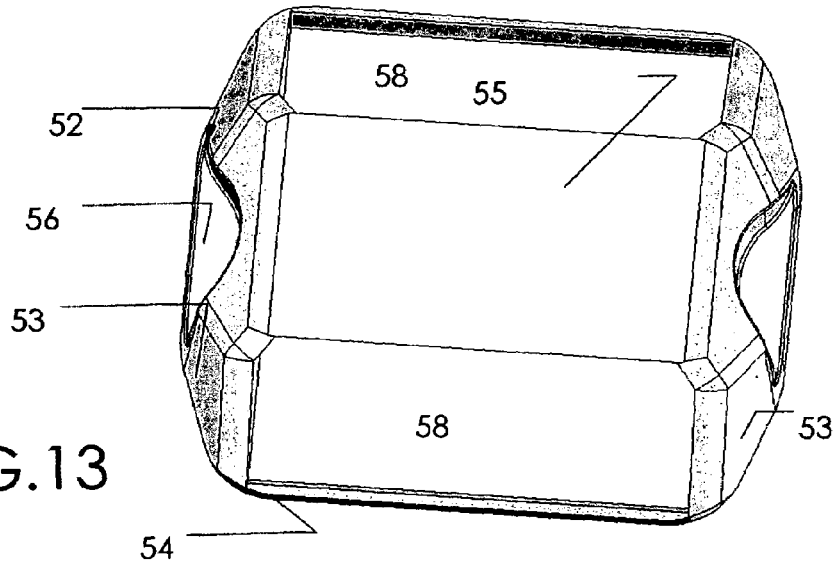
FIG.13
FIG.14
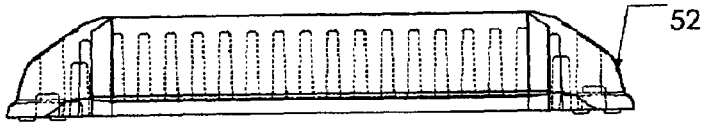
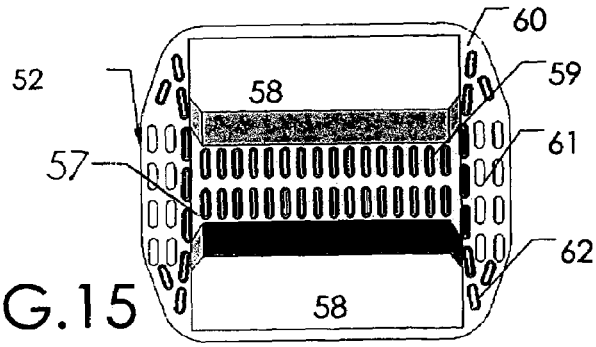
FIG.15

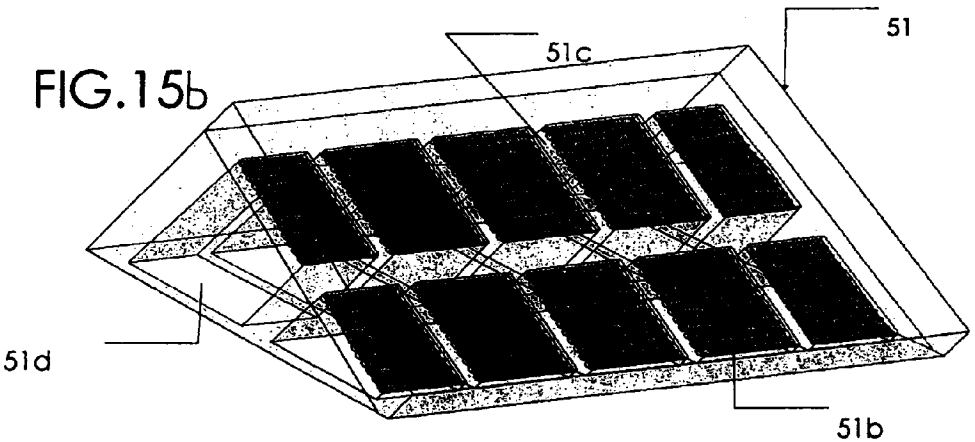
FIG.15b
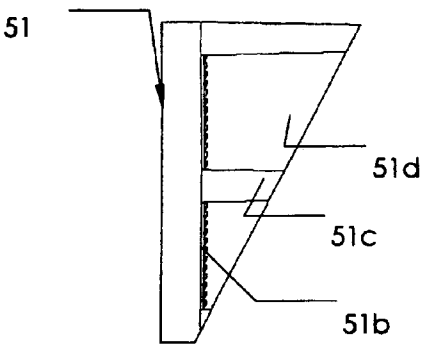
FIG.17
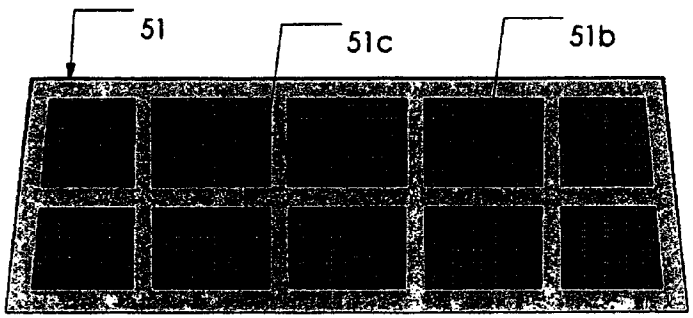
FIG.16
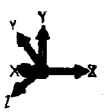

UNITARY BODY FOR REFLECTIVE PAVEMENT MARKER

FIELD OF INVENTION

The present invention relates to improved pavement marker that includes retro-reflective faces and luminance body surface color which can be used for day and night traffic lane delineation. In particular, such a marker is having a monolithically formed hollow structural body having a sealed base including protruded and recessed grooves, a planar top surface, forwardly tilted multi angular sides each with finger grip slot and inclined front and back faces with recesses for lens plate attachment.

BACKGROUND OF THE INVENTION

Roadway markers are mounted on the surface of a roadway, along centerlines, edge lines, to delineate lanes for vehicular traffic.

Examples of commonly used retro-reflective pavement markers using a shell like housing filled with structural polymeric filler material are based on Heenan U.S. Pat. No. 3,332,327, Balint U.S. Pat. No. 3,409,344, or Hedgewick U.S. Pat. No. 5,002,424.

This type of markers are made of three to four steps or processes:

Firstly, injection molding a thermoplastic housing (shell), integrally molded with one or two reflective faces, the shell coated with a reflective metallic sealer by a process known as vacuum metalizing, the shell is then filled with a resinous filler material encapsulating the metalized cube corner reflective elements, thereby provide the marker the impact resistance structural body. This type of markers worked well for several months; however, due to sharp exterior geometric edge configuration and the incompatibility of the material composition for forming this type of markers with potted shell, often causes pealing and chipping of the reflective faces, thereby losing retro-reflectivity. Several method of applying abrasion resistant coating has been used to improve such pavement markers.

Other major development in the pavement marker art has been made; this was achieved by eliminating the use of the metalized sealer for the cube corner reflective elements. This applicant's U.S. Pat. No. 4,726,706, which is incorporated herein by reference in its entirety, divide the inside surfaces of the reflective faces into reflective cells, each cell having multiple cube corner reflective elements, the cells isolated from each other by partition and load carrying walls. The inside surfaces of the reflective faces are sealed with a thin polymeric sheet. Other prior art pavement markers have been designed attempting to reduce oncoming tire impact, attain better daytime visibility by incorporating luminescence color dyes or pigmentations. U.S. Pat. No. 5,667,335 to Khieu discloses a pavement marker comprises of three distinct parts, a base part with structural walls defining hollow cavities, a fiber reinforced shell having two inclined faces with at least one face having raised energy directors within a recessed area and at least one reflective lens plate having cube corner reflective elements.

U.S. Pat. No. 6,102,612 to Pricone discloses a sun country pavement marker 105 comprises a body member 110, a top member 130, and one or two reflective lens plates 192 agglutinated within designated recesses. In order to form hollowed body member 110, the top surface is open defining the hollowed body, which is sonically sealed with the additional third member 130 to complete a unitary structural body.

Several prior arts attempted to utilize a unitary structural body for reflective pavement marker fabrication. For example, U.S. Pat. No. 5,392,728 to Spear et al discloses an extruded one piece body with constant cross section having abrupt vertical sides which can be strongly felt during tire impact.

U.S. Pat. No. 4,875,798 to May et al discloses a pavement marker having one piece rigid body supported with partitions walls forming multiple hollow cavities which are open at the base surface. These open cavities at the base eliminated considerable bonding base surface parameter, thereby reduced the bond to the roadway surface.

U.S. Pat. No. 6,109,821 to Montalbano discloses a pavement marker with one piece solid body made of a closed cell foam thermoplastic. This type of material has limited durability due to the air entrapment for creating a low density solid plastic body.

The use of monolithically formed one piece hollowed structural body integrally containing multiple load carrying walls with wedge shaped top ends was disclosed by this Applicant's U.S. Pat. No. 6,267,530, No. 6,334,734 and U.S. Pat. No. 6,579,036. Although the wedged shape top surfaces of the load carrying walls within the recessed area of the front and back faces of the structural body of '036 was deemed to be sufficient for directly welding the reflective lens plate. However, there was no recognition apparent from the '530, 734 or '036 patents that the energy directors at top of each partition wall defining the reflective cells within the lens plate need to land and subsequently welded to a flat region on top of each wedge shaped top regions of the partition walls within the recessed faces of the structural body.

Also, there was no recognition apparent from the '530, '734 or '036 patents that the base surface of the structural body can integrally incorporate two types of grooves, a recessed deep grooves (cavities) within the center portion of the base region to reduce the polymeric material used to form the marker body and multiple slightly protruded grooves beneath the front, sides and back faces of the marker body. It has been found that by integrally incorporating at least one recessed V-shaped channel within the base surface will improve agglutination by reducing air bubble entrapment during agglutination of the marker base to a substrate, acting as air bleeding channel. The present invention's raised pavement marker with tilted, multi angular sides attain better daytime visibility by exposing larger non-reflective exterior surfaces areas to the vehicular traffic. Such frontal non-reflective surfaces within the marker body of the present invention are especially effective when incorporating fluorescent colorant dyes such as (thioxanthene) compounds, phosphorescent pigments such as (Strontium) and other luminescent dyes manufactured by pigment and dye manufacturers such as BASF, Day Glo Inc, American Dye Source Inc. Ciba-Geigy Corporation and others. Such colorants are added to the polymeric matrix as a blend to provide luminance yellow, orange, red or other colorant appearance for improving day time appearance and night time fluorescent visibility.

An example of such readily available fluorescent dye blends are D-191 and D-098 (yellow), D-063 and D-315 (orange) which are manufactured by Day-Glo Inc.

There is a continuous development of new and improved fluorescent colorants by several dye and pigment manufacturers. Some have developed new proprietary phosphorescent pigment that can glows for hours. By incorporating (Strontium), an earth alkaline, a self-emitting light technology allows an after glow time to exceed 12 hours which make it to be ideal luminous pigment for traffic safety applications.

Many of these proprietary dyes chemistry are based on compounds that include (Thioxanthene) dyes.

These types of dyes are readily available in the market place as proprietary owned by others. Incorporating luminescent materials within traffic marking objects is a well known art. Several prior arts have utilized fluorescent colorants for traffic and pavement marking devices. As an example, U.S. Pat. No. 3,592,777 assigned to Owens-Illinois; U.S. Pat. No. 3,830,682 to William Rowland; U.S. Pat. No. 3,908,055 to Susuki et al; U.S. Pat. No. 4,208,300 to Phillippe Gravisse and U.S. Pat. No. 5,213,711 to Fast et al.

This invention also provides an alternative method of monolithically injection molding the unitary structural body in situ about one or two lens plate structures.

The lens plate structures utilized to form a reflective pavement marker in accordance to the present invention may be either simultaneously formed within the same rotary mold used in a two color (or two materials) injection molding machine, in one or two rotational steps. Alternatively, the lens Plates are pre-formed and inserted within a defined portion of a mold used to form the unitary body in a one-color injection molding machine. Both, the pre-insertion process (using a one-color injection molding machine) or simultaneously forming the transparent lens plates and the unitary body in a two-color injection molding machine allows the molding of the unitary marker body in situ about one or two lens plate means. These processes can be used to provide cavity means within the unitary structural body for pre insertion of other devices, such as luminance tube with LED as power source that may be used for light emitting or flashing light control means. Some devices may be controlled via light control information or programs stored in device memory and/or transmitted or downloaded to the devices. Devices also may include sensors so that the generated light may change in response to various operating or a user input.

This invention's unitary marker body can also be provided with means to embed photovoltaic cells within the top planar surface and utilized as a rechargeable power source for LED.

The goal of this invention is to have a highly versatile process for making a durable raised reflective pavement marker with high daytime and nighttime visibility and reflectance, low cost and can incorporate fluorescent dyes for light glowing or flashing effects which is utilizing the monolithically formed one piece structural body.

It has been found that incorporating one row of hollow cavities with variable depth on each side of the lens plates and open within the base surface will act as a shock absorber when vehicular tire impact the outer side of these hollow cavities, thereby minimize deflection caused by the impact stresses which may lead to lens plates dislodgement from the recessed face regions of the body.

SUMMARY OF THE INVENTION

The principle object of the present invention is to provide a retro-reflective pavement marker having an improved unitary structural body formed in situ about at least one pre-formed reflective lens plate means, said body provides improved daytime and nighttime visibility by providing forward and backward tilted side surfaces facing incoming vehicular traffic, incorporating luminance colorant dyes, incorporating multiple of protruded grooves and air bleeding channels within the base surface to improve agglutination, partition walls within the reflective faces having flat top surfaces for attaching the lens plate means and providing a lens plate attachment means having improved retro-reflective face with protective raised bumpers. Another objective of the present invention is to provide a one-piece multi-sided reflective pavement marker with a unitary structural body having two inclined reflective faces and incorporating fluorescent colorant compounds such as colorant dyes containing (thioxanthene) compounds and other luminescent dyes manufactured by third party such as Ciba-Geigy Corporation, BASF, Day Glo Inc, American Dye Source, Inc. etc. Such dye blends can be added to the polymeric matrix as a blend to provide luminance yellow, orange, red or other colorant appearance for improving day time appearance and night time fluorescent visibility, or incorporate phosphorescent pigment such as (Strontium), an earth alkaline, for self-emitting light after glow.

Yet another object of present invention is to incorporate multiple rectangular hollow cavities directly on the sides of the lens plates and open within the base surface, which act as shock absorber when vehicular tire impact the tilted angular sides.

This invention also provides an alternative method of monolithically injection mold the structural body in situ about one or two lens plate means. The lens plate means may be either simultaneously formed within the same mold used in a (two color injection molding machine) in one or two rotational steps, or alternatively, the lens plate means are pre-formed or pre inserted within a defined portion of a mold used in a (one color injection molding machine).

These methods of monolithically forming a two colored, one-piece marker will provide the means for a multitude of processes, whereby either a shell-like top transparent segment is formed as a first step including a luminance transparent colorant and simultaneously injection molding the remaining opaque structural body.

An alternative process is by injection molding a shell like transparent skin that would includes at least one retro-reflective face, followed by luminescent structural body elements.

Another object of the present invention's one-piece marker forming processes is to provide the means to incorporate various exemplary implementations of light emitting diode (LED) or blue filtered halogen based illumination products which can produce flashing luminance light into, but not limited to, raised pavement marker having flashing night lights, reflective sheet marking, decorative marker with lights such as light tubes and methods. The foregoing raised marking devices may be equipped with various means of user interfaces (both "local" and "remote") to control light generated from the device.

Additionally, devices may be controlled via light control information or programs stored in device memory and/or transmitted or downloaded to the devices. Devices also may include sensors so that the generated light may change in response to various operating or a user input. This invention's marker body can also be provided with means to embed photovoltaic cells as a rechargeable power source.

BRIEF DESCRIPTION OF THE DRAWINGS

FIGS. 13, 14 and 15 are an isometric view, an elevation view and a bottom plan view for the unitary structural body of the one-piece marker shown in FIGS. 11 and 12;

FIGS. 15*b*, 16 and 17 are an isometric view, a plan view and a side view respectively for one of the preferred pre-inserted or preformed lens plate having structural wall encasement;

DETAIL DESCRIPTION OF PREFERRED EMBODIMENTS

Figure 4:
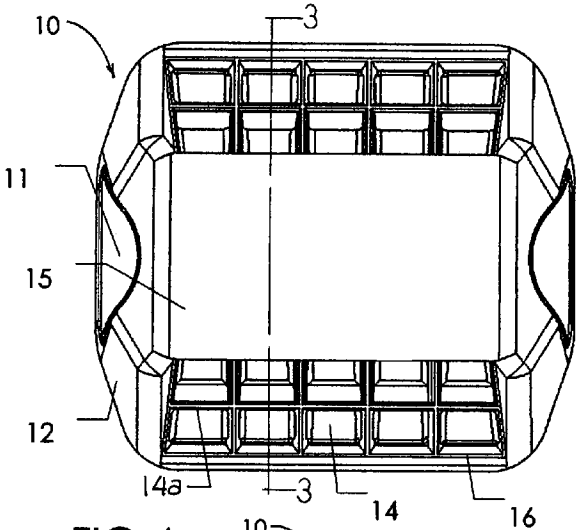
FIG. 4 is a plan view of the unitary marker body of FIG. 1.
Figure 5:
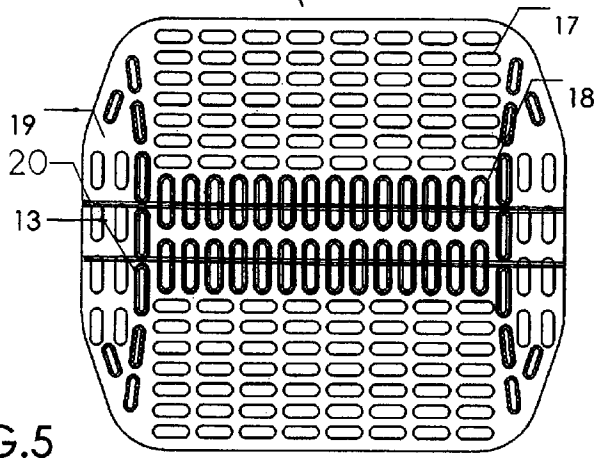
FIG. 5 is a plan view for a preferred base surface for the unitary marker body of FIG. 1 showing a preferred arrangement for multiple recessed cavities in the center, recessed side cavities and the protruded grooves on the remaining surfaces.
Figure 1:
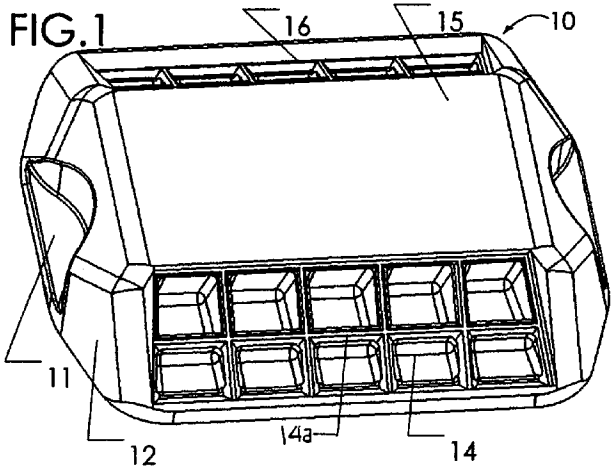
FIG. 1 is an isometric view of a preferred unitary reflective pavement marker body having faces with multiple angular hollow cavities and multi angular sides with finger grip slots.
Figure 2:
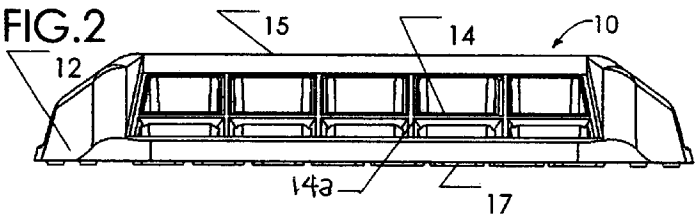
FIG. 2 is an elevation view of the unitary marker body of FIG. 1, showing the multi angular sides.
Figure 3:
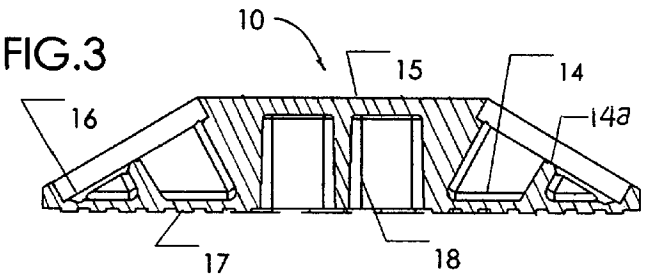
FIG. 3 is a cross sectional view for the unitary body of FIG. 1 thru line 3-3 shown in FIG. 4.
Figure 9:
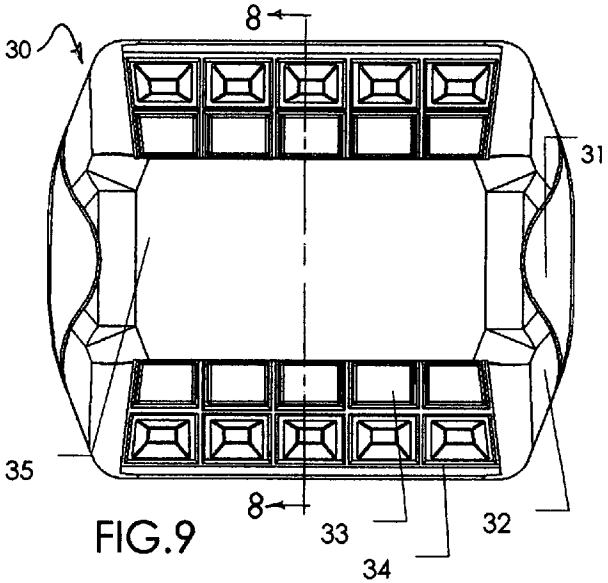
FIGS. 9 and 10 are the top and bottom plan views respectively for the unitary marker body of FIG. 6.
Figure 6:
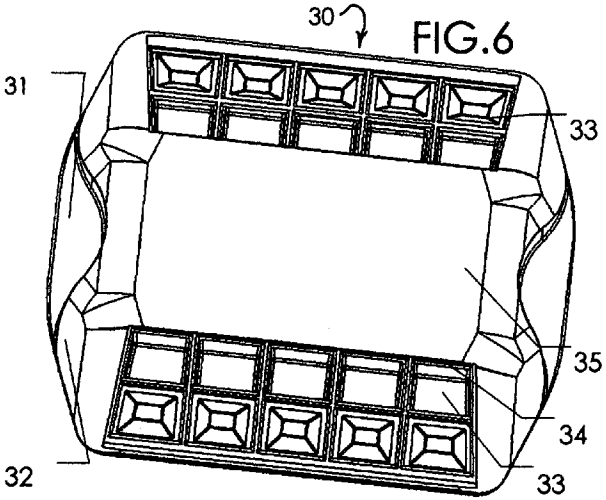
FIG. 6 is an isometric view of another preferred unitary marker body having faces with vertically positioned hollow cavities.
Figure 7:
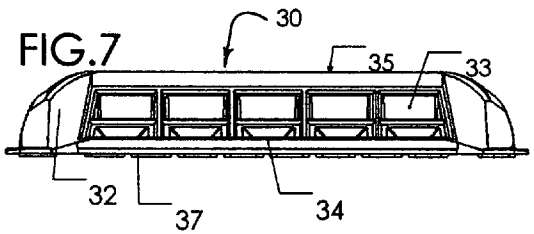
FIG. 7 is an elevation view for the unitary marker body of FIG. 6.
Figure 8:
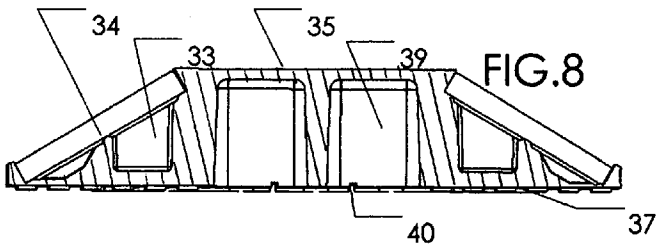
FIG. 8 is a cross section view for the unitary body in FIG. 6 thru line 8-8 shown in FIG. 9.

The raised unitary reflective pavement marker body 10 (shown in FIGS. 1 thru 5), pavement marker body 30 (shown in FIGS. 6 thru 10) and unitary pavement marker 50 formed in accordance to the present invention are to include all the advancement and improvements provided by this applicant previous U.S. Pat. Nos. 6,267,530, #6,334,734, #6,579,036, 6,698,972, #6,821,051 and #7,025,528 which are herein incorporated by reference. However, the present invention provides unitary pavement marker body 10, 30 and 50 having additional improvements which were not recognized by the '530, '734, '036, '972, '051 and '528 patents.

Referring now to the unitary reflective pavement marker structural body 10 in FIGS. 1-6, is having a top planar surface 15, multi angular sides 12 with improved finger grip portions 11, planar top surface 15, a base surface 19 integrally including recessed hollow cavities 13, 18 and protruded grooves 17, said marker body 10 also includes a front and back inclined faces each with recessed area 16 for receiving reflective lens plate means and integrally incorporating multiple hollow cavities 14.

Typically, the unitary body for patents '734 and '036 provide a wedge shaped top surfaces for the walls defining the hollow cavities 14. The present invention provides a flattened top surface regions 14*a* on the upper top segments of the partition walls wedged top portions. As in '734, these partition walls define the hollow cavities 14.

The hollow cavities 14 are positioned to have centerlines nearly perpendicular to the corresponding inclined face 16. This angular positioning of hollow cavities 14 reduce the plastic material needed to form the center region for the unitary body 10 and reduce the overall size and depth of hollow cavities 18 that is incorporated in the center region of base surface 19 and directly beneath the top surface 15.

Additionally the angular positioning of the partition walls defining hollow cavities 14 will have stronger position against direct vehicular tire impact.

Utilizing angular hollow cavities 14 are applicable where the overall marker body has width of about 4.0 to 6.0 inches and a depth of about 3.0 to 4.0 inches.

Figure 10:
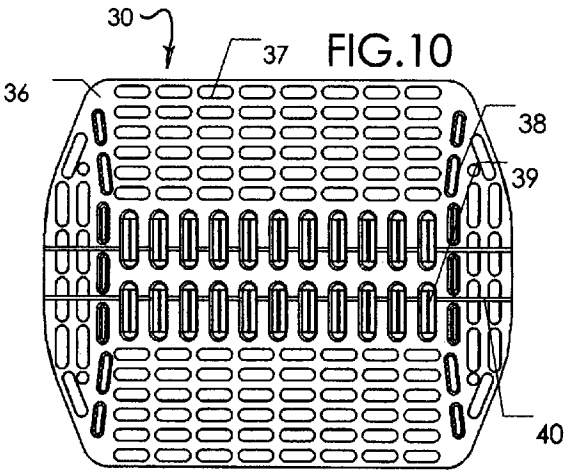
Figure 10C:
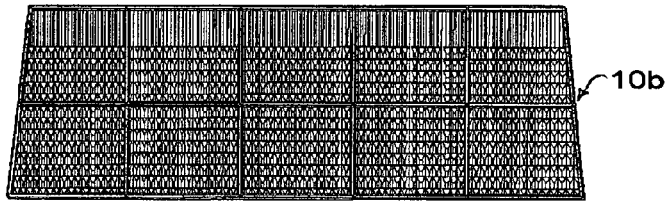
FIG. 10*c* is one of the preferred reflective lens plate means that can be attached to unitary body of FIG. 1 or FIG. 6 to form a reflective pavement marker.

Typically two lens plate means similar to lens plate means 10*b* shown in FIG. 10*c* are welded in the recessed areas 16 of the unitary body 10 to complete a reflective pavement marker of the type claimed in the present invention and commonly used on roadways. It should be noticed that lens plate 10*b* is not drawn to scale or does not show the preferred reflective prism means. The base surface 19 for the unitary marker body 10 is formed with various protruded grooves 17 and hollow cavities 13 and 18. Firstly, multiple of hollow cavities 18 formed within the deep center region and directly bellow the outside top surface 15. These hollow cavities 18 will have uniform depth of about 0.10 to 0.60 inches and preferably about 0.5 to 0.57 inches.

The second sets of hollow cavities 13 are lined up in two rows to the sides of both inclined front and back faces that house the reflective lens plates means such as lob. Cavities 13 are variable in depth and formed to act as shock and impact absorbers. When a vehicular tires impact force hit a marker body side 12 the force victor will cause deflection of the outer side of cavities 13 while the inner side of cavities 13 will not be effected.

The remaining planar base surfaces are integrally include multiple of protruded grooves 17, each with a height of about 0.015 to 0.05 inch high. The entire base surface is formed with rough textured surface. About one to three trough shaped recess channels 20 are integrally formed directly on the planar base surface and across the entire width of the unitary marker body 10. Channels 20 are utilized as an air bleeding channels and will have a depth of about 0.01 to 0.03 inches, said channels 20 are also used to improve base surface adhesion parameter.

The foreword tilted sides 12 of unitary marker body 10 enhance the daytime visibility by exposing larger areas within the non-reflective surfaces of body 10 to vehicular traffic.

The non-reflective portions of sides 12 within the marker body 10 of the present invention are especially effective when incorporating fluorescent colorant dyes such as (thioxanthene) compounds, phosphorescent pigments such as Strontium and other luminescent dyes. Luminance dyes are normally blended with the polymeric resins used for forming the unitary body 10 to provide the kind of color appearance or luminance effects desired. Various colors are readily available including but not limited to luminance yellow, orange, red, etc.

Such luminance dyes are proprietary of third party pigment and dye manufacturers such as Ciba-Geigy Corporation, BASF, Day-Glo Inc, and American Dye Source, Inc. etc.

Such luminescent colorant dyes can also be incorporated to the polymeric matrix as a blend to provide luminance yellow, orange, red or other colorant appearance for improving day time appearance and night time fluorescent visibility.

An example of such readily available fluorescent dye blends are D-191 and D-098 (yellow), D-063 and D-315 (orange) which are manufactured by Day-Glo Inc.

There is a continuous on going development of new and improved pigments, fluorescent colorants and light emitting diode (LED) based illumination processes and methods, which are readily available from third party developers or manufacturers. These luminance colorants formulated to be incorporated into various plastic product applications such as the present inventions marker body or lens plates. Some manufacturers have developed new proprietary phosphorescent pigment that can glows for hours. By incorporating (Strontium) which is an earth alkaline, a self-emitting light technology allows an after glow time to exceed 12 hours which make it to be ideal luminous colorants for traffic safety applications.

Figure 10B:
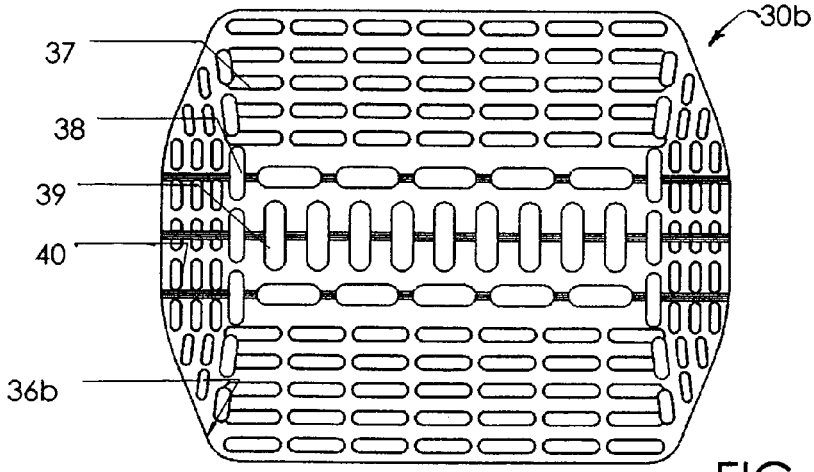
FIG. 10*b* is another configuration of a base surface that can be integral part of body of FIGS. 1 and 6.

Another preferred unitary pavement marker body 30 shown in (FIGS. 6 thru 10) is basically similar in surface geometry and having a planar top surface 35, a front and back inclined faces 34 for attaching lens plates, two angular sides with forward and backward tilting surfaces 32, each side includes an improved finger grip region 31, a base surface 36 with four types of grooves and cavities, a set of deep evenly recessed cavities 39 in the middle of said base surface 36, two rows of recessed side cavities 38 with variable depths, multiple of slightly protruded grooves integrally dispersed on the remaining regions of base surface 36 and at least two channeled recesses 40 across the entire width of said base surface 36. The front and back inclined faces 34 each incorporate two rows of recessed cavities 33 formed having centerlines forming a vertical angle with respect to the base surface 36. FIG. 10*b* shows an alternative base surface arrangement 36*b* including hollow cavities 39, cavities 38, bleeding channels 40 and protruded grooves 37. Base surface 36*b* can be alternatively be used as part of unitary body 10 or 30. The unitary marker body 30 is ideal for applications that require an overall marker width of about 4.0 to 8.0 inches and a depth of about 2.5 to 3.5 inches, preferably about 3.0 to 3.25 inches in depth which can be formed in a simple tooling apparatus without any slides.

Figure 12:
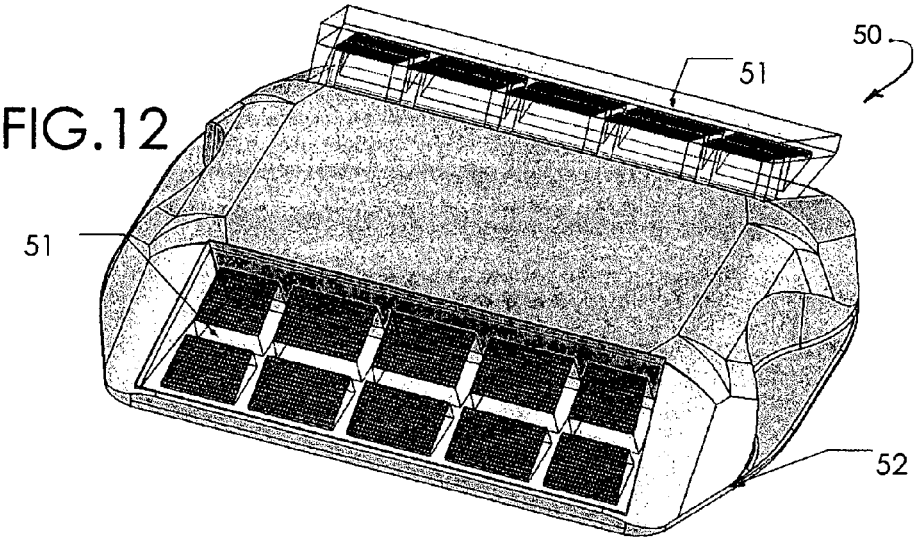
FIG. 12 is a second isometric view of the one-piece marker shown in FIG. 11 with one of the pre-inserted or pre-formed reflective lens plate means is pulled slightly outside the unitary structural body portion for distinctively showing the space relationship between the two parts.
Figure 11:
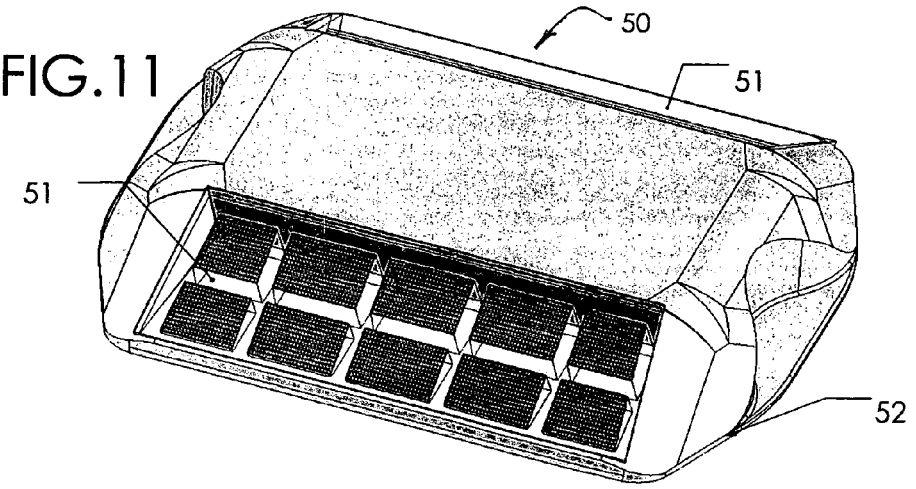
FIG. 11 is an isometric view of a preferred one-piece reflective marker having two reflective faces.
Figure 11:
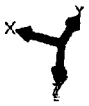

FIGS. 11 thru 18 show an alternate unitary pavement marker body 52 integrally formed to encapsulate two preformed reflective lens plates 51, thereby forming a one-piece, two way reflective marker 50 shown in FIGS. 11 and 12.

The process of forming unitary body 52 in situ about one or two lens plates 51 is primarily depend on firstly pre-forming lens plate means such as 51 (detailed in FIGS. 13-15); either within the same mold or lens plates 51 are pre-formed and pre-inserted in a fixed position within the unitary body mold prior to injection molding the marker unitary body 52.

Other lens plate means can be used which may include fluorescent colorant and could house LED elements for emitting flashing light.

Figure 18:
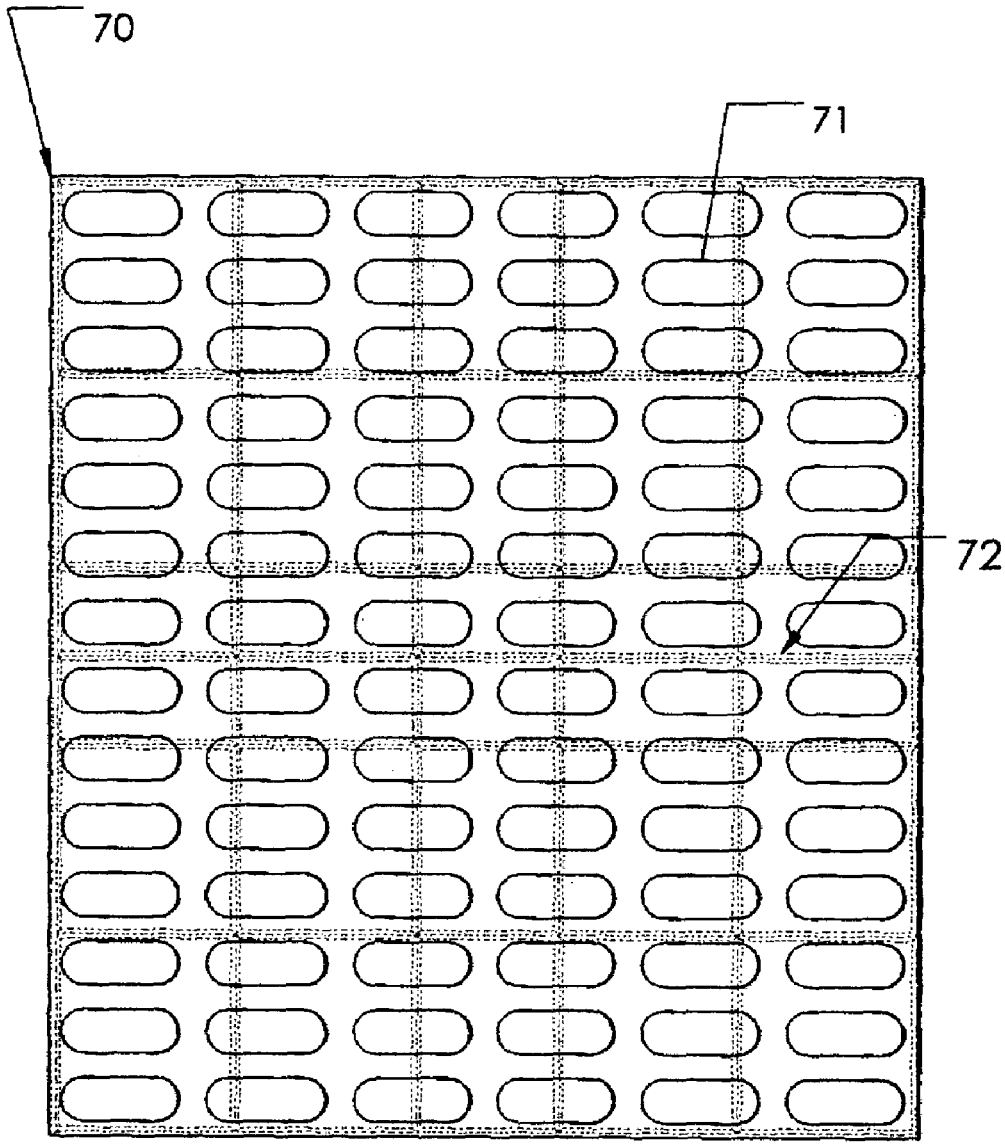
FIG. 18 is typical sheet used for sonically sealing the base surface of a one-piece marker of FIG. 11.

The unitary pavement marker body 52 integrally includes a planar top surface 55, two multi surfaced sides 53 each with improved finger grip slot 56, two oppositely inclined faces 54 each with an open slot 58 that will encapsulate a lens plate mean such as 51 during injection molding body 52 and a base surface 60 having deeply recessed cavities 59 in the center area, two rows of side recesses 62 with variable depths, multiple of protruded grooves 61 on the sides of base surface 60 and a recessed center area 57 for attaching a thin sealing sheet means such as 70 having beads or energy directors 72 on one side and protruded grooves 71 on the outside surface, as shown in FIG. 18.

FIGS. 13, 14 and 15 show one of the preferred configurations of a lens plate means 51 integrally having a planar transparent face surface with reflective cells 51*b*, partition walls 51*c* defining cells 51*b* and periphery walls 51*d* around the entire lens plate 51.

Alternatively, the present invention can incorporate similar lens plate means as the lens plate means used in patent Nos. '530, '734 or '036.

The process of monolithically forming a two colored, one-piece marker provide the means for a multitude of processes, whereby either a shell-like top transparent segment of body 52 is firstly formed as a first step including a luminance transparent colorant, pre-inserting a luminance tube with LED and then injection molding the remaining opaque structural body.

An alternative process is by injection molding a shell like transparent skin that would includes at least one retro-reflective face, followed by injection molding the unitary structural body elements having luminescent pigment.

Additionally, the present invention's one-piece marker forming processes provide the structural walls and hollow space means that would easily be reconfigured to incorporate various exemplary implementations of light emitting diode (LED) or blue filtered halogen based illumination products which can produce raised pavement marker having flashing luminance night lights, luminance reflective sheet marking, decorative marker with luminance lights. The LED can be positioned within a fluorescent light tube and pre-inserted into the faces or be embedded within the center portion of the unitary body 52 having luminosity colorant. The foregoing raised marking devices may be equipped with various means of user interfaces (both "local" and "remote") to control light generated from the device.

To provide an abrasion resistant exterior surface protection for the reflective lens plate means as well as for the unitary marker body 10, 30 or 52, a liquid coating composition is available from several third party suppliers. Material such as a dispersion of silica colloid with multifunctional acrylate polymer coating formulations is commonly applied in either sprays or brush application. Several abrasion resistant resin coating compositions are readily available and applicable for use in the present invention, and are discussed in U.S. Pat. Nos. 4,355,135, 5,126,394 and 5,648,173, assigned to Dow Corning Corporation, U.S. Pat. No. 4,486,504 to Chung et al, and U.S. Pat. No. 4,702,773 to Lysander, which are herein incorporated by reference.

It will be understood that the particular embodiments of the invention are shown by way of illustration and not as limitation of the invention. The principal features of this invention can be employed in various embodiments without departing from the scope and the spirit of the invention. Incorporating flashing light power source or halogen within the unitary marker body This invention is not limited to the exact apparatuses illustrated and described; alternative apparatus can be used to form the intended monolithically formed reflective pavement marker body as well as the reflective lens plate means of this invention.

Changes or modifications can be made within the scope of the appended claims to the above-preferred method of forming one-piece reflective marker body. Therefore; the invention can be practiced otherwise than as specifically described herein.

What is claimed is:

1. A unitary polymeric body used as structural body for reflective pavement marker, said unitary body is molded to include front and back inclined faces, each of said inclined faces is having a recessed area for attaching a reflective lens plate means, each recessed area includes multiple of partition walls defining hollow cavities, said unitary body having a planar base surface including shock absorbing hollow cavities, protruded rectangular grooves and air bleeding channels.

2. The unitary pavement marker body as set forth in claim 1, wherein said base surface having two rows of recessed hollow cavities within a center portion of said base surface, said hollow cavities having a depth of about 0.10 to 0.60 inches deep.

3. The unitary pavement marker body as set forth in claim 1, wherein said base surface having a row of recessed hollow cavities with variable depths along each sideline of the reflective lens plates within the front and back inclined faces of said unitary marker body, said sideline hollow cavities acting as an impact and shock absorbing cavities.

4. The unitary pavement marker body as set forth in claim 1, wherein said base surface is having slightly protruded rectangular grooves, tapered and fillet corners, said grooves are protruded about 0.01 to 0.05 inched above said planar base surface.

5. The unitary pavement marker body as set forth in claim 1, wherein said base surface is having two recessed bleeding channels integrally formed across the entire width of said base surface to minimize air entrapment during agglutination process, said recessed channels having are about 0.01 to 0.03 inch in depth.

6. The unitary pavement marker body as set forth in claim 1, wherein said unitary marker body incorporate various types of pigments or fluorescent dyes used for enhancing the unitary marker body surface color and appearance during daytime or nighttime.

7. A multi-sided unitary polymeric body used as a structural body for reflective pavement marker, said unitary body is molded in situ about a sealed periphery of at least one pre-formed reflective lens plate means, thereby forming an integrally bonded one-piece reflective marker, said in situ forming of said unitary body about lens plate means is achieved either within the same rotary mold of a two color injection molding machine or said lens plate means are pre-formed and inserted in a fixed position within the unitary body mold used in a one color injection molding machine prior to injection molding said unitary body, said unitary body having a bottom surface including multiple of centralized hollow cavities, one row of hollow cavities with variable depths along each side of said base surface, multiple of slightly protruded grooves and a recesses central region for attaching a polymeric sealer sheet.

8. The multi-sided unitary polymeric body used as a structural body as set forth in claim 7, wherein said unitary body incorporate fluorescent dye means assisted by light emitting diode (LED) or other power source means to provide flashing luminance night lights.

9. The multi-sided unitary polymeric body used as a structural body as set forth in claim 7, wherein said recessed base surface is sonically sealed with a compatible plastic sheet.

10. The multi-sided unitary polymeric body used as a structural body as set forth in claim 7, wherein said transparent reflective lens plate means having multiple reflective cells integrally defined by internal load carrying partition walls and periphery walls.

* * * * *